US012480700B2

(12) United States Patent
Wu et al.

(10) Patent No.: US 12,480,700 B2
(45) Date of Patent: Nov. 25, 2025

(54) DYNAMIC COOLER CONFIGURATION

(71) Applicants: Joseph Wu, Glendora, CA (US); Adam Wu, Glendora, CA (US); Aaron Wu, Glendora, CA (US)

(72) Inventors: Joseph Wu, Glendora, CA (US); Adam Wu, Glendora, CA (US); Aaron Wu, Glendora, CA (US)

( * ) Notice: Subject to any disclaimer, the term of this patent is extended or adjusted under 35 U.S.C. 154(b) by 80 days.

(21) Appl. No.: 18/454,727

(22) Filed: Aug. 23, 2023

(65) Prior Publication Data

US 2025/0067494 A1 Feb. 27, 2025

(51) Int. Cl.
*F25D 3/06* (2006.01)

(52) U.S. Cl.
CPC ..... *F25D 3/06* (2013.01); *F25D 2303/08221* (2013.01); *F25D 2303/08222* (2013.01); *F25D 2303/0841* (2013.01); *F25D 2303/0843* (2013.01); *F25D 2303/0845* (2013.01)

(58) Field of Classification Search
CPC ..... F25D 2303/08221; F25D 2303/00–2303/085; F25D 3/08; F25D 2303/082
See application file for complete search history.

(56) References Cited

U.S. PATENT DOCUMENTS 4,024,731 A * 5/1977 Branscum ..... F25D 3/00 215/385
2018/0093816 A1* 4/2018 Longley ..... F28D 20/02
2024/0032501 A1* 2/2024 Fuchs ..... A01K 1/0157

FOREIGN PATENT DOCUMENTS

JP 2015087060 A * 5/2015
KR 200475106 Y1 * 11/2014 ..... F25D 3/08
WO WO-2007066093 A2 * 6/2007 ..... F25D 3/06

OTHER PUBLICATIONS

English language translation of 200475106 (Year: 2014).*
English language translation of JP2015087060 to Higure. Translated Apr. 2025 (Year: 2015).*

* cited by examiner

*Primary Examiner* — Cassey D Bauer
(74) *Attorney, Agent, or Firm* — LeonardPatel PC; Sheetal S. Patel; Michael A. Leonard, II

(57) ABSTRACT

An example device includes a first liquid container with a bladder and a number of flaps and a second liquid container with a bladder and a number of flaps, and one of the flaps of the second liquid container is affixed to one of the flaps of the first liquid container.

12 Claims, 14 Drawing Sheets

DYNAMIC COOLER CONFIGURATION

FIELD

This application relates to a cooler and more specifically to a cooler configuration with dynamic and customizable liquid filled cooling packs.

BACKGROUND

Conventionally, a cooler requires a user to find various sources of cold or freezing ice cubes, ice packs and other cold instruments to place in a cooler in order to establish a cold environment that can chill items placed in the cooler.

Ice will melt and create liquid, such as water, which will need to be emptied from the cooler. Depending on the intended contents of the cooler, the arrangement of cold packs and ice may be optimized to rapidly cool the contents of the cooler.

SUMMARY

Example embodiments of the present application provide a dynamic cool pack and cooler configuration.

One example embodiment may include a first liquid container including a bladder and a plurality of flaps, and a second liquid container having a bladder and a plurality of flaps, and one of the flaps of the second liquid container is affixed to one of the flaps of the first liquid container.

Another example embodiment may include a cooler having a plurality of affixing elements disposed on surfaces of an internal portion of the cooler, and a plurality of liquid containers affixed to the affixing elements in a fixed position inside the cooler.

DETAILED DESCRIPTION OF THE EMBODIMENTS

It will be readily understood that the components of the present application, as generally described and illustrated in the figures herein, may be arranged and designed in a wide variety of different configurations. Thus, the following detailed description of the embodiments, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in one or more embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
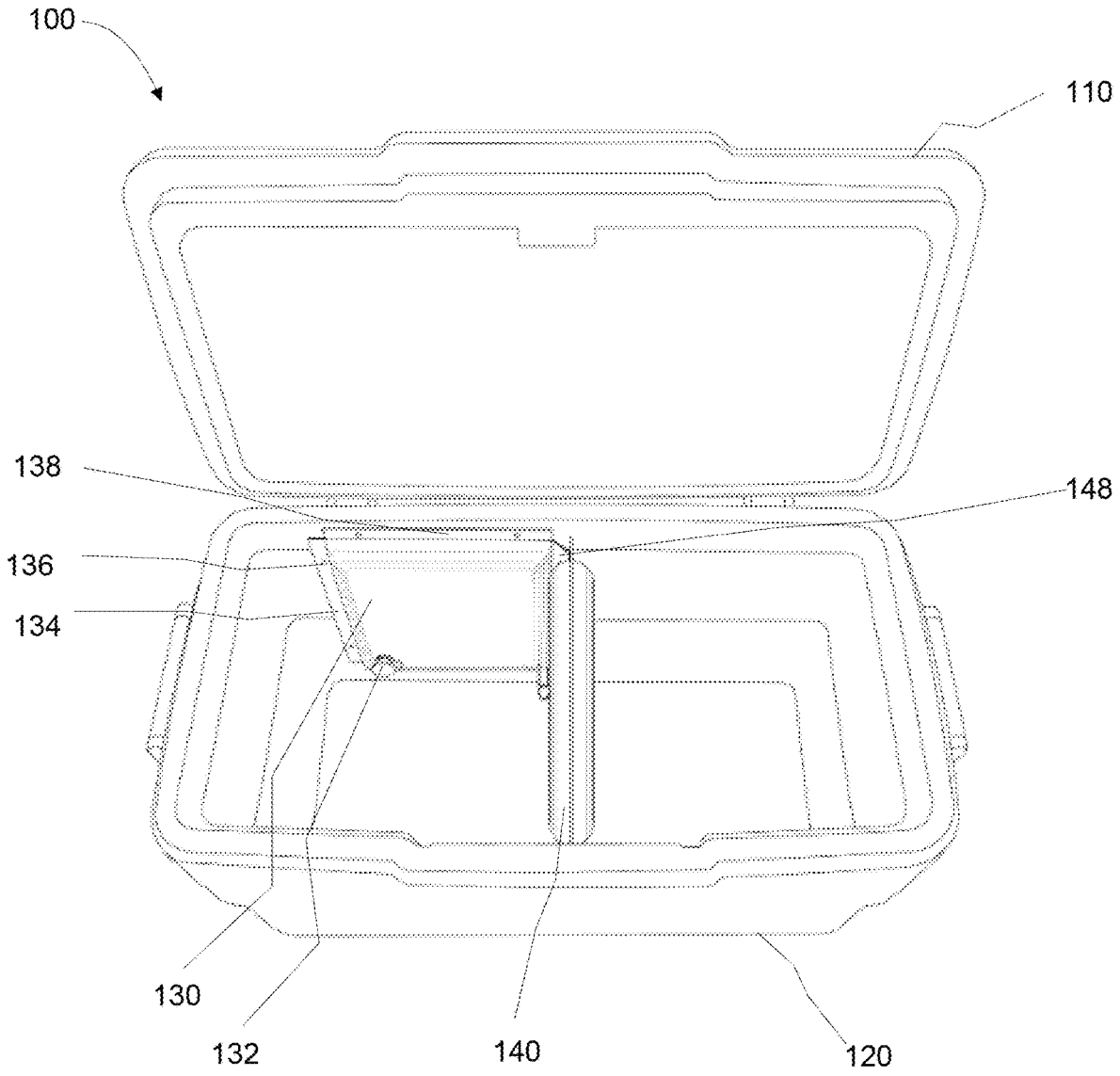
FIG. 1 illustrates a cooler with one example cooling pack configuration according to example embodiments.
Figure 12:
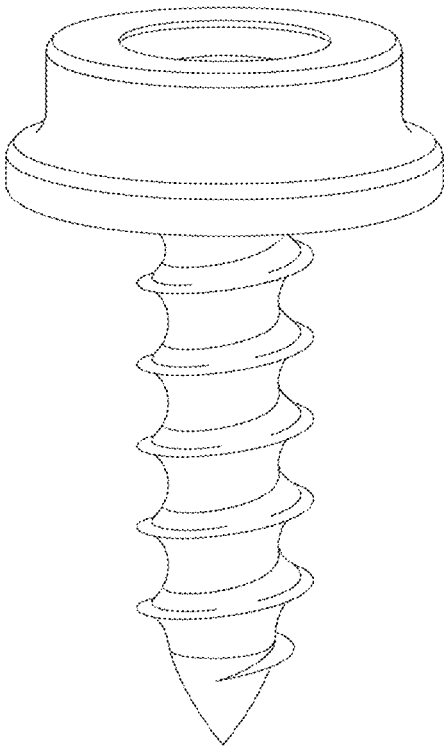
FIG. 12 illustrates a detailed view of a snap screw stud fastener according to example embodiments.

FIG. 1 illustrates a cooler with one example cooling pack configuration according to example embodiments. Referring to FIG. 1, the cooler 100 includes a top portion or lid 110 and a bottom portion or base 120. The cooler may have an array of receiving holes which permit pop-in studs, screws or nails to be used to secure one or more cooling packs 130/140 to a wall or floor of the cooler. FIG. 12 illustrates one example of a snap screw stud fastener 131, which will be referred to as a 'snap screw' for simplicity. Each cooling pack 130/140 may be affixed to the walls or floor of the cooler via securing studs, magnets, VELCRO®, zippers, etc. The cooler may have a plurality of affixing elements, such as button snap sockets and/or studs, pieces of VELCRO, magnetically attracted surfaces, magnets, etc.

It is important to note that the cooling pack may instead be a warming pack filled with warm fluid instead of cold fluid to warm the contents of a cooler. For example purposes the pack will be referred to as a cooling pack even though it may be a warming pack. In general, the snap configuration may include a snap button head or snap button socket. If a square cooling pack has four sides, each side may have a set of snap button heads and/or snap button sockets to receive the snap button heads.

In operation, a user may customize the configuration of the cooler body by affixing one cooler pack 130 to the back wall and another cooler pack 140 down a center of the cooler. Each cooler pack may have a panel of holes to permit the studs to pass through the affixing surfaces or flaps 134/138/148. The flaps may be on all sides (e.g., 3 or 4) of the pack and may be joined together from one flap of one packet to another flap of another pack. Each pack may also have an access hole and lid 132 that permits liquid to be added and removed to an internal bladder portion of each pack. The packs may be referred to as liquid containers or bladders.

Figure 2A:
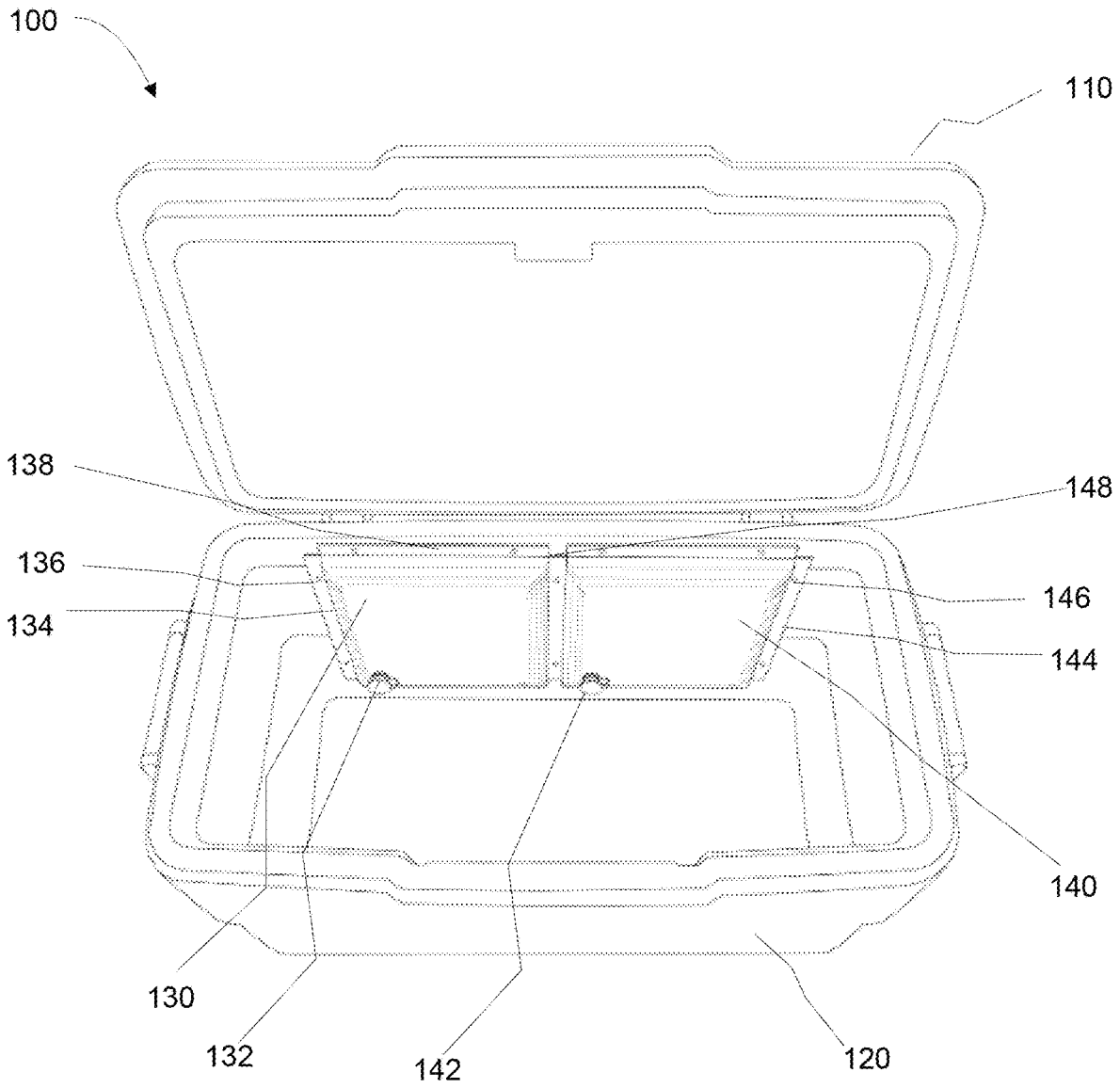
FIG. 2A illustrates a cooler with another cooling pack configuration according to example embodiments.

FIG. 2A illustrates a cooler with another cooling pack configuration according to example embodiments. Referring to FIG. 2A, in this configuration, the two packs are both affixed to the back wall of the cooler body 120. Both packs 130 and 140 have similar designs including flaps 138/148/144, pass through slots 134/144 and bladder holes/lids 132 and 142. The packs may be affixed to the back wall by studs, magnets, zippers, VELCRO or other affixing configurations.

Figure 2B:
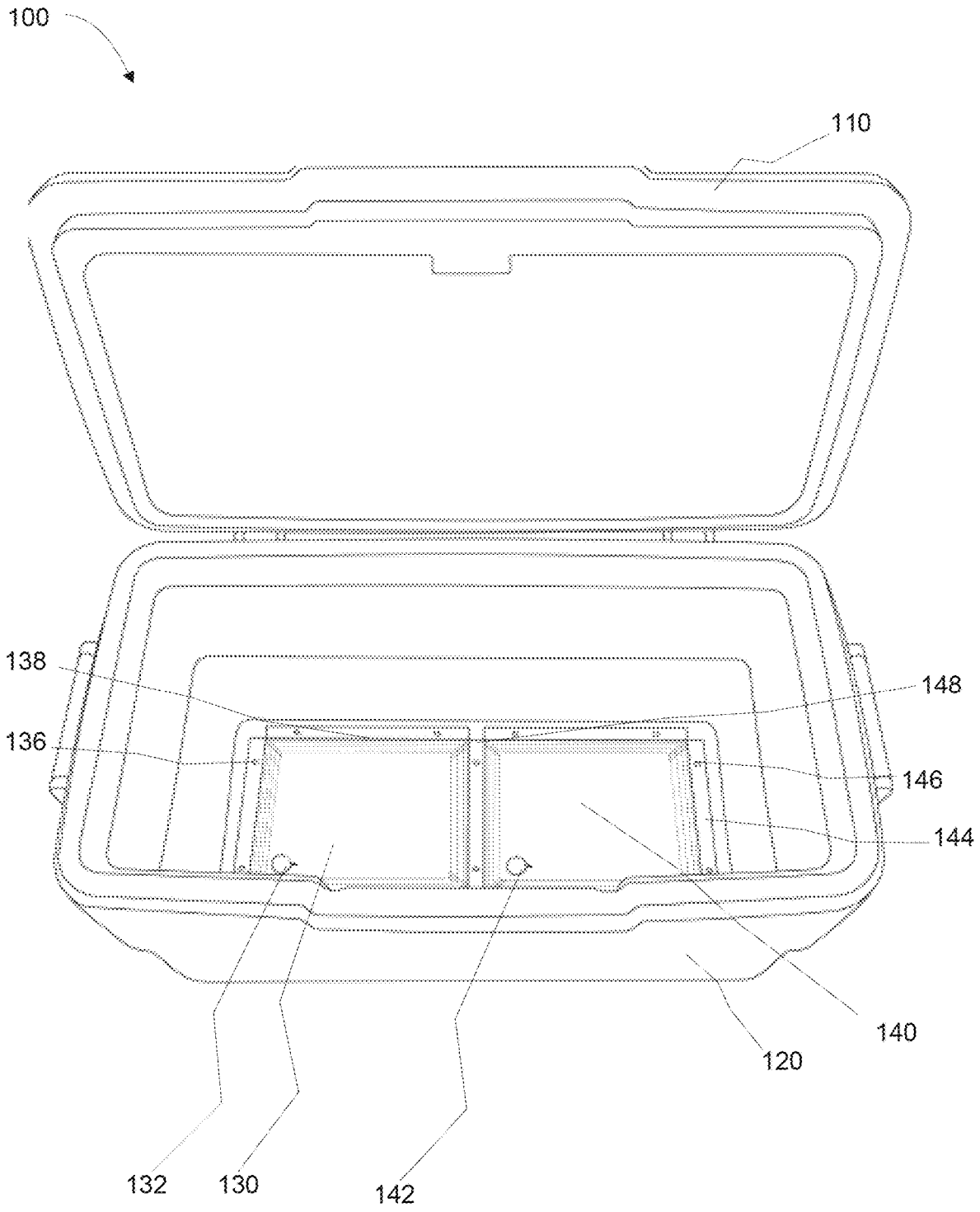
FIG. 2B illustrates a cooler with another cooling pack configuration according to example embodiments.

FIG. 2B illustrates a cooler with another cooling pack configuration according to example embodiments. Referring to FIG. 2B, the dual pack configuration demonstrates two packs affixed together on a bottom surface inside the cooler 100. Similar to the example in FIG. 2A, the packs may be laid flat without any snaps affixed to snap screws or with snaps snapped onto the snap screws beneath the surface of the packs. The packs may be laid side by side independently or as a single joined pair of packs which have been affixed to one another prior to being laid inside the cooler floor.

Figure 3A:
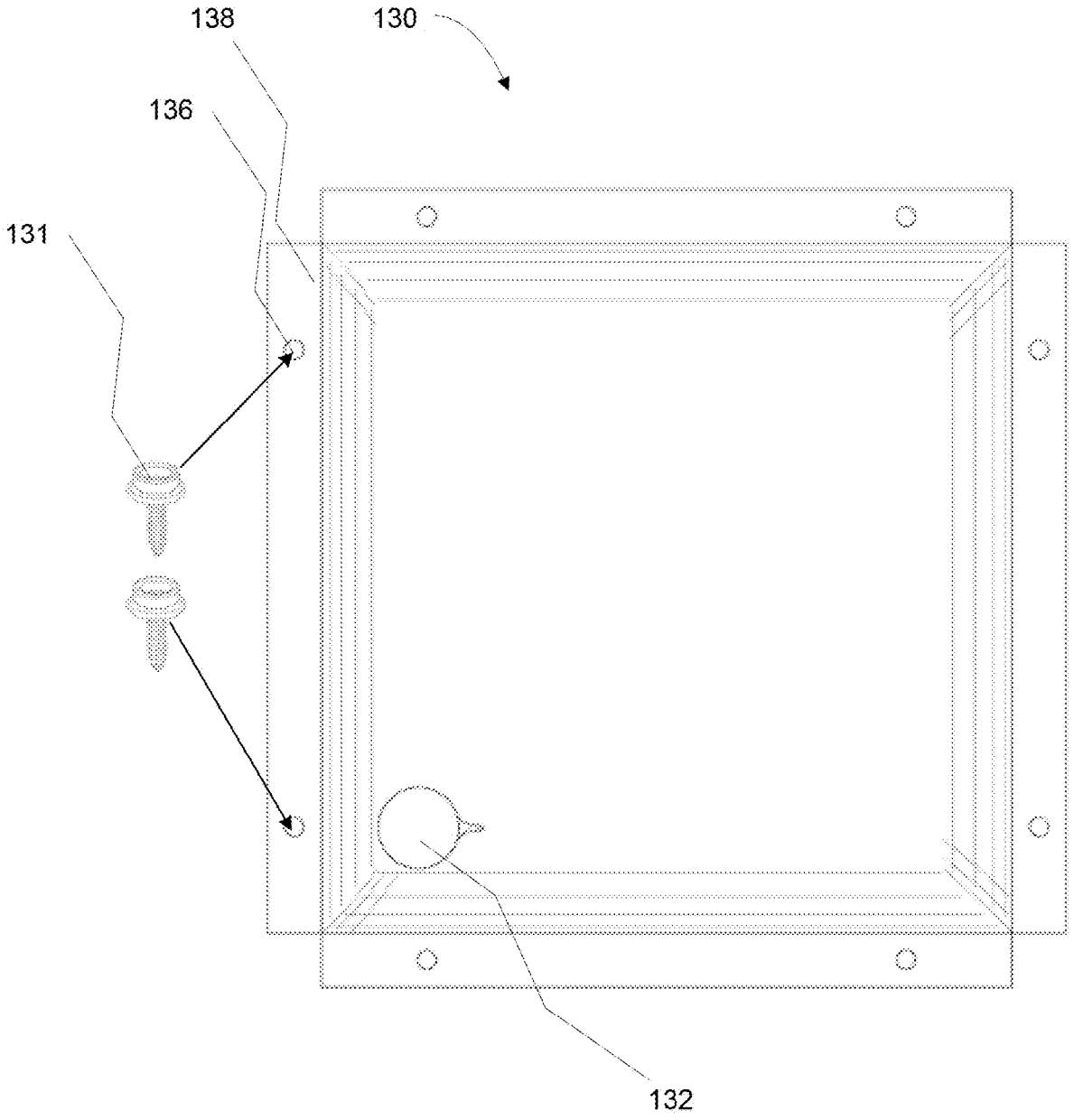
FIG. 3A illustrates a cooling pack configuration according to example embodiments.

FIG. 3A illustrates a cooling pack configuration according to example embodiments. Referring to FIG. 3A, the example pack 130 includes a plurality of pass through slots or embedded snap heads 136 (eight snaps in this example), which permit pop-in or push actuated studs, bolts or simply just snap fasteners 131 to secure the pack to the internal cooler body.

Figure 3B:
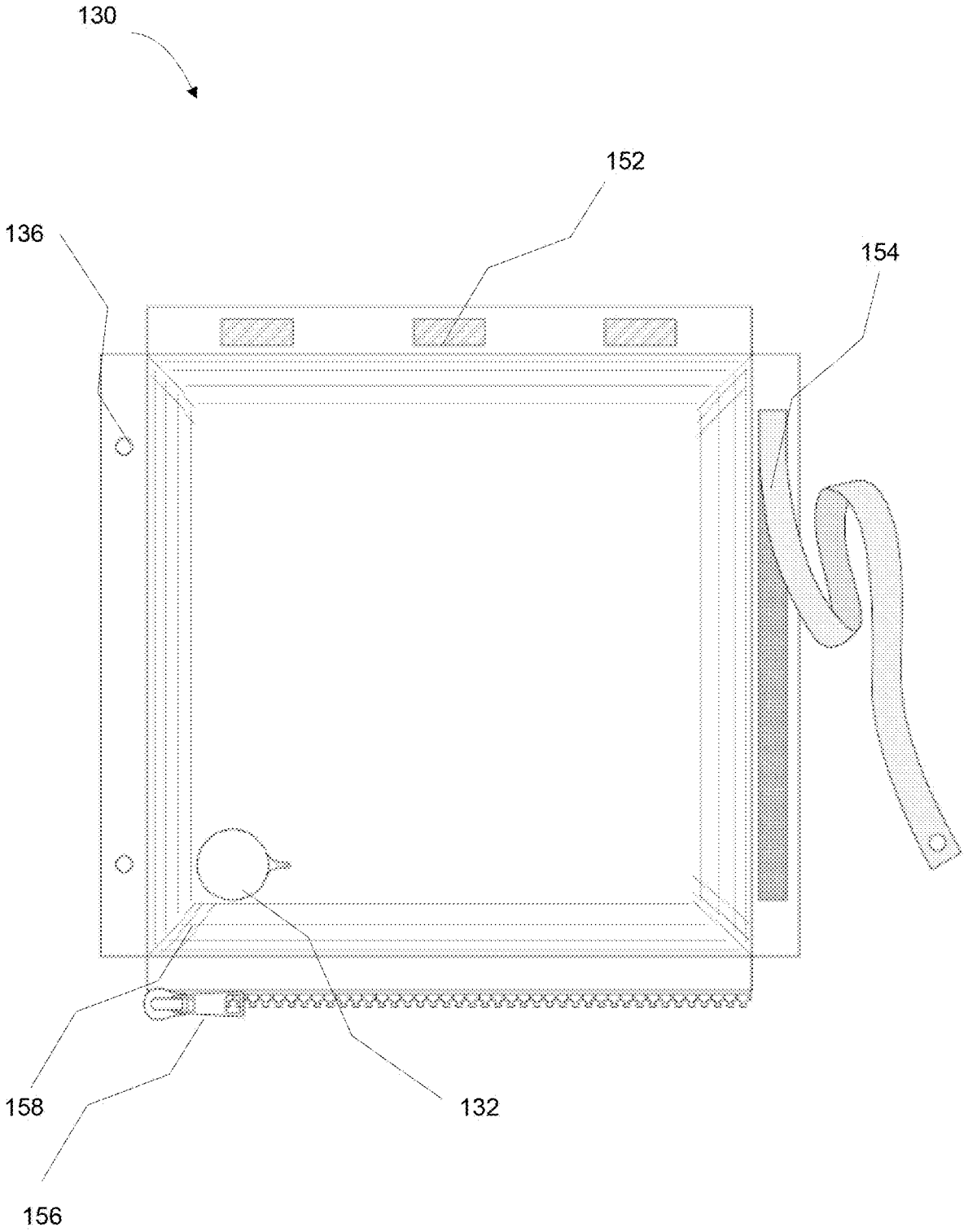
FIG. 3B illustrates a variety of cooling pack affixing configurations according to example embodiments.

FIG. 3B illustrates a variety of cooling pack affixing configurations according to example embodiments. Referring to FIG. 3B, the example illustrates how a single pack could have magnets 152, slots/snaps 136, VELCRO 154, zipper 156, etc., used to affix the pack to the cooler body. The pack may be approximately 1 to 4 inches in depth and may have a sloped surface 158 that leads from the pack end to a pack center portion.

Figure 4:
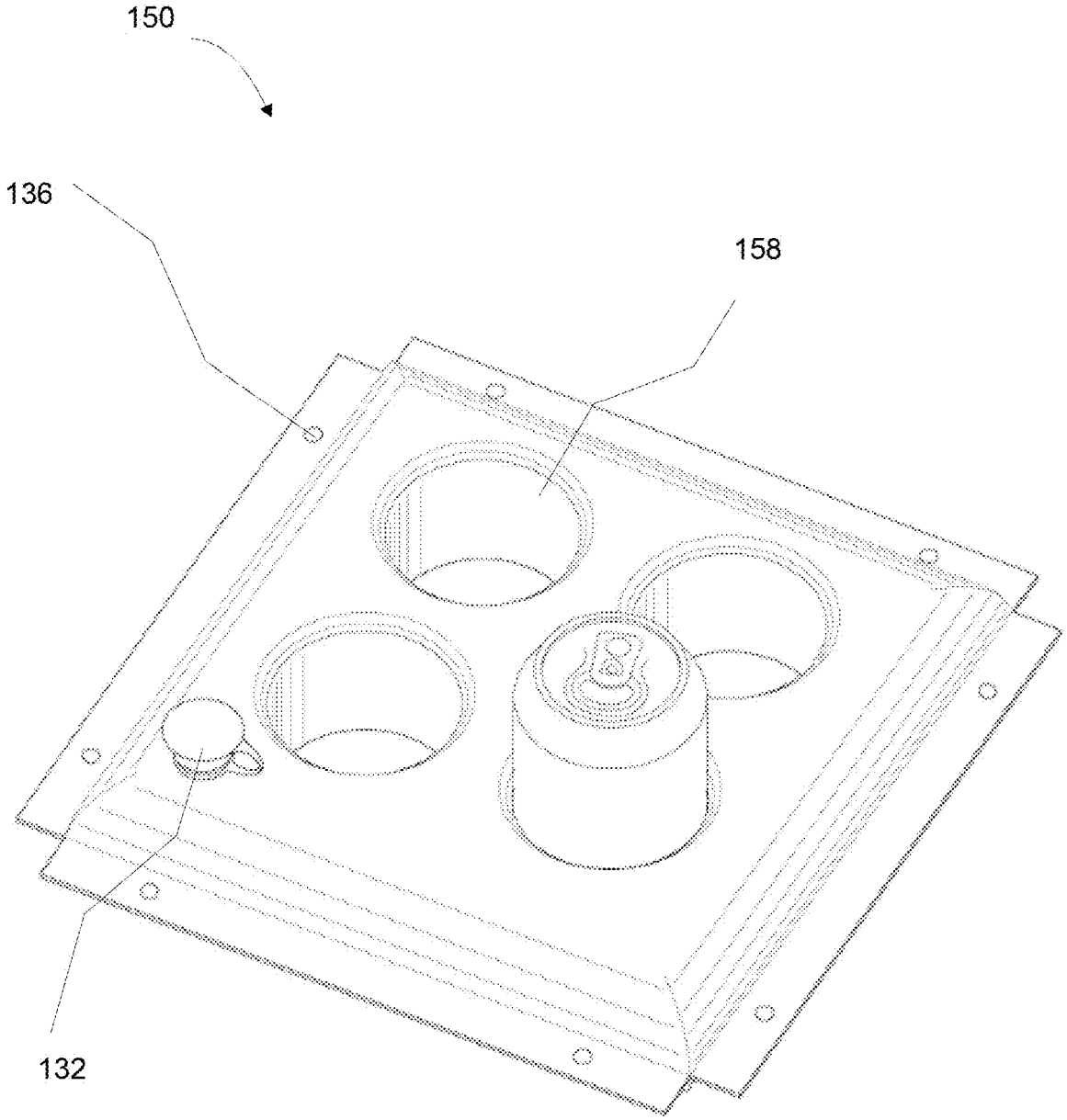
FIG. 4 illustrates a beverage holding cooling pack configuration according to example embodiments.

FIG. 4 illustrates a beverage holding cooling pack configuration according to example embodiments. Referring to FIG. 4, the pack example 150 demonstrates how a series of beverage cavities 158 are included in the surface of the pack to permit a beverage to be quickly chilled when inserted into the one or more cavities.

Figure 5:
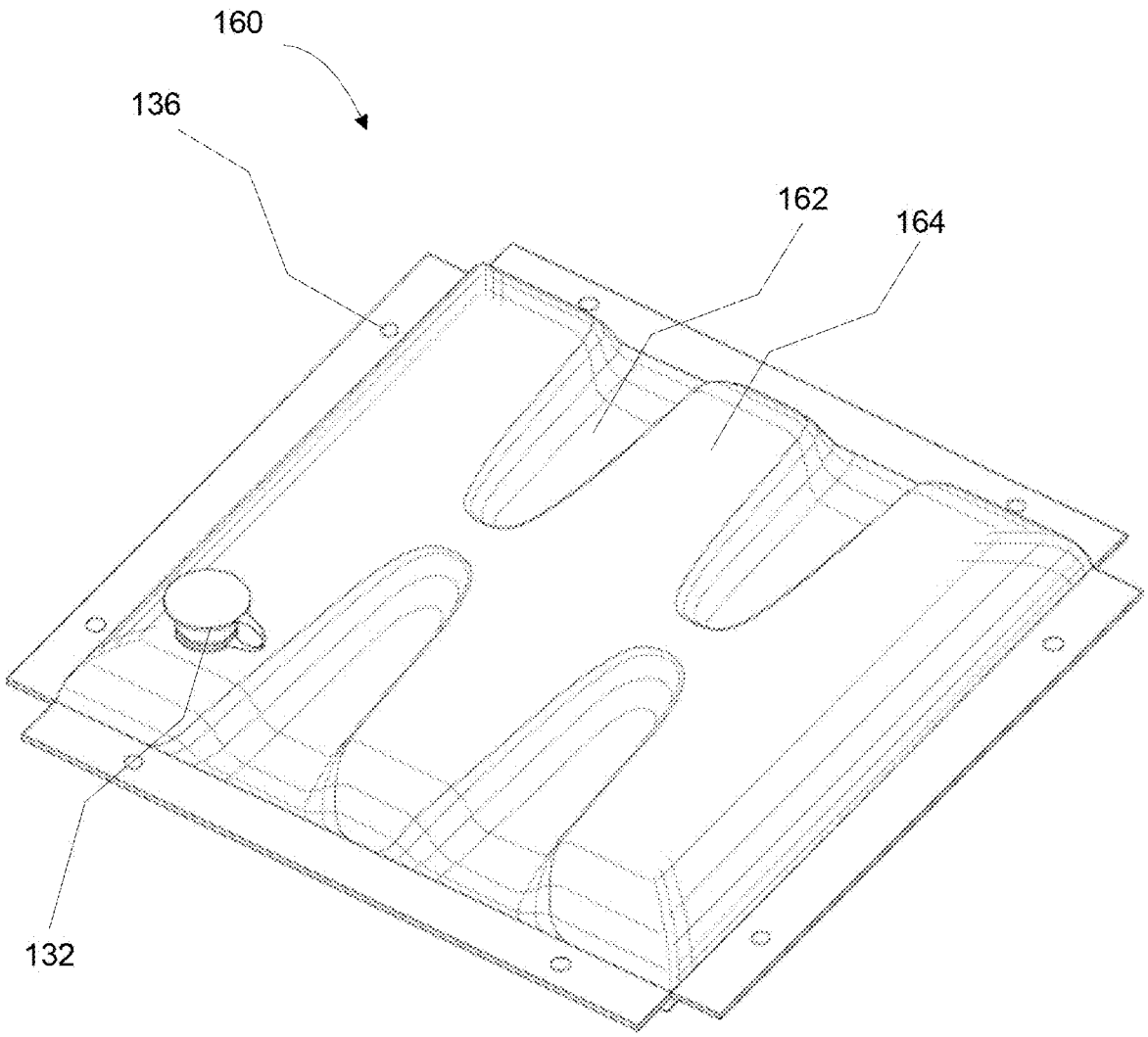
FIG. 5 illustrates a liquid arrangement cooling pack configuration according to example embodiments.

FIG. 5 illustrates a liquid arrangement cooling pack configuration according to example embodiments. Referring to FIG. 5, the pack 160 includes radiator style bladder design where peaks 164 and valleys 162 are used to harness the locations of the liquid inside the pack. The gaps between each finger of the radiator will allow the ice pack to bend, which is helpful in cooling curved objects.

Figure 6:
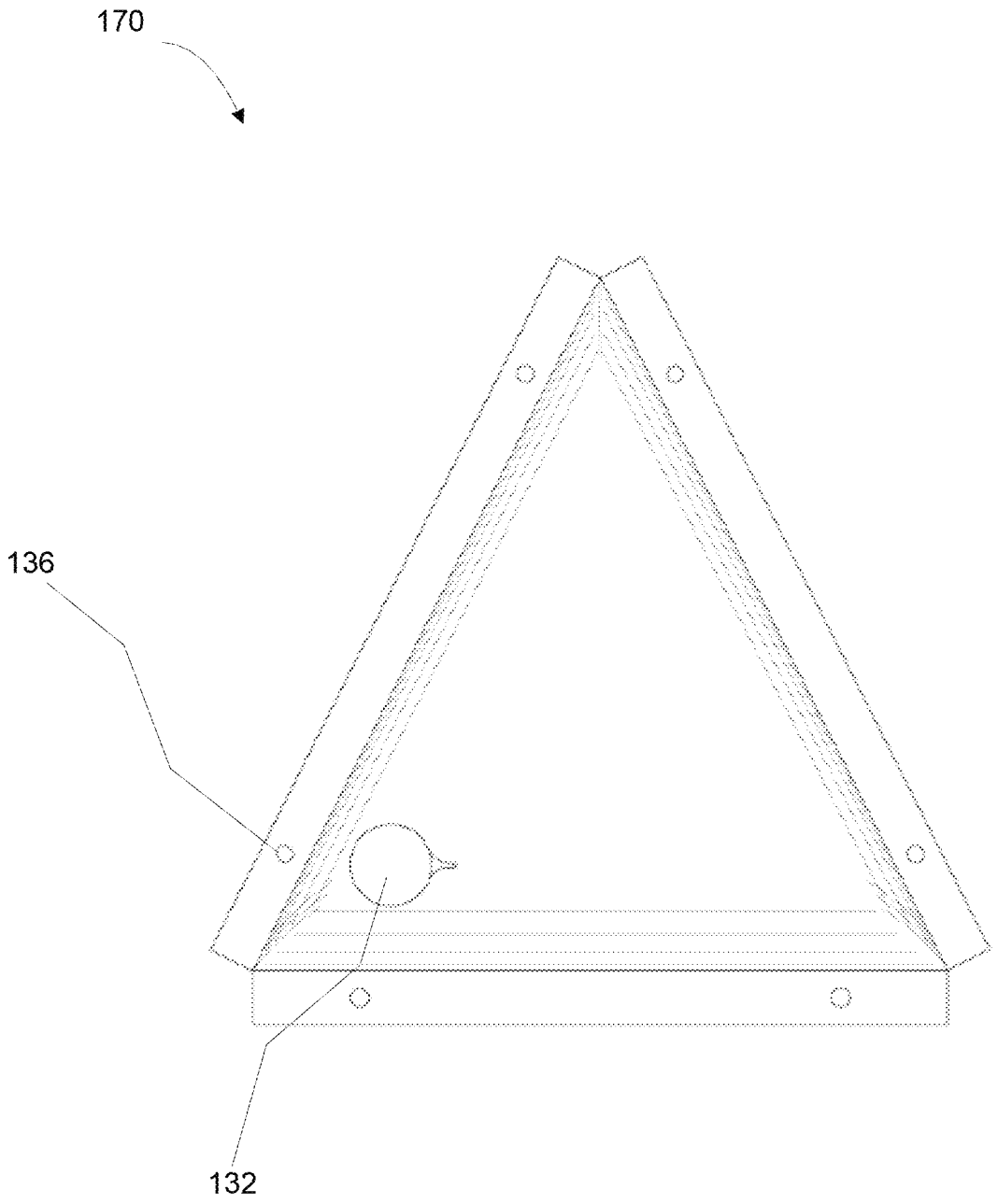
FIG. 6 illustrates an alternatively shaped cooling pack configuration according to example embodiments.

FIG. 6 illustrates an alternatively shaped cooling pack configuration according to example embodiments. Referring to FIG. 6, the example pack 170 is triangular to accommodate narrower areas inside a cooler body.

Figure 7:
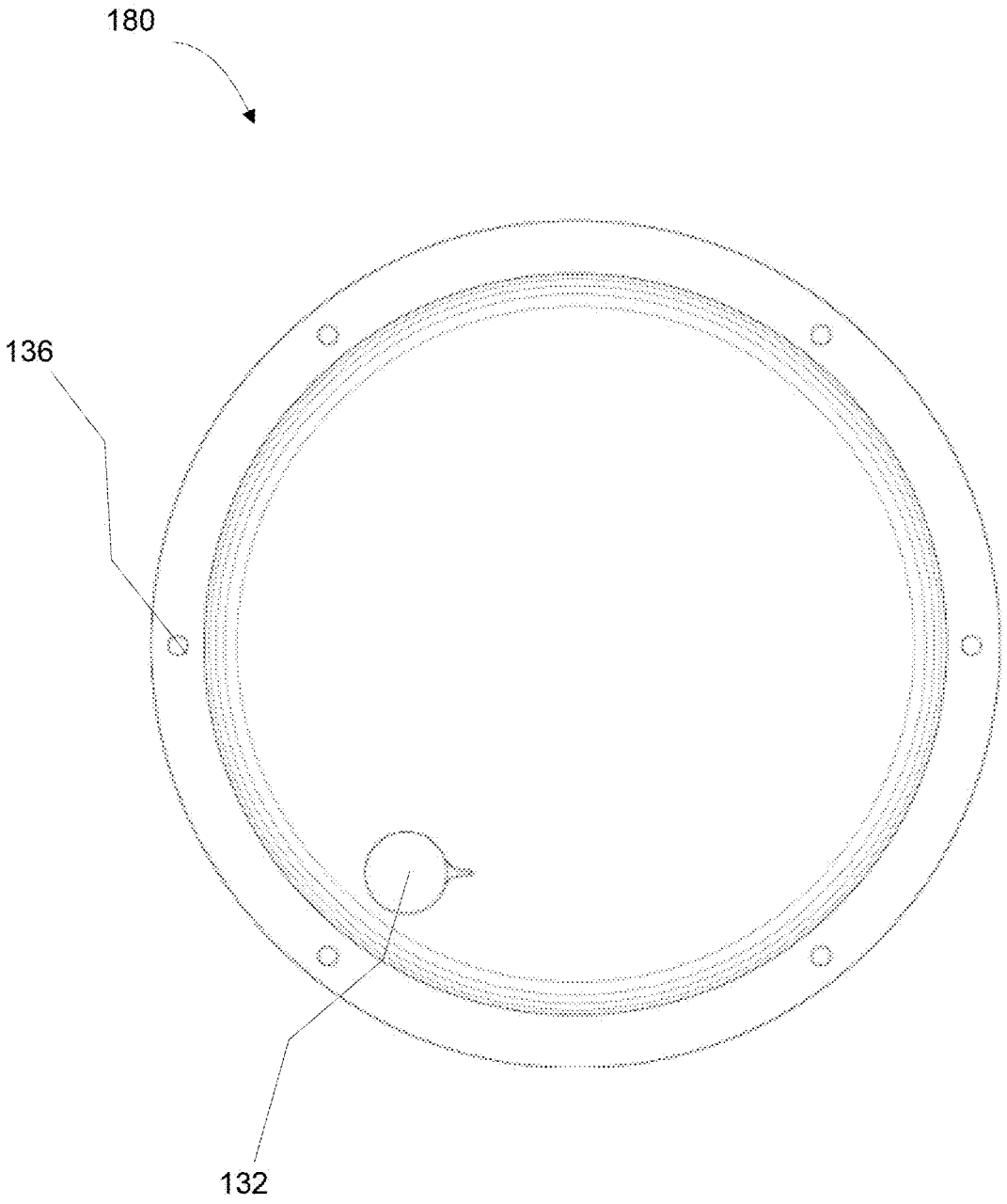
FIG. 7 illustrates another alternatively shaped cooling pack configuration according to example embodiments.

FIG. 7 illustrates another alternatively shaped cooling pack configuration according to example embodiments. Referring to FIG. 7, the example pack 180 is circular to accommodate rounder areas inside a cooler body.

Figure 8:
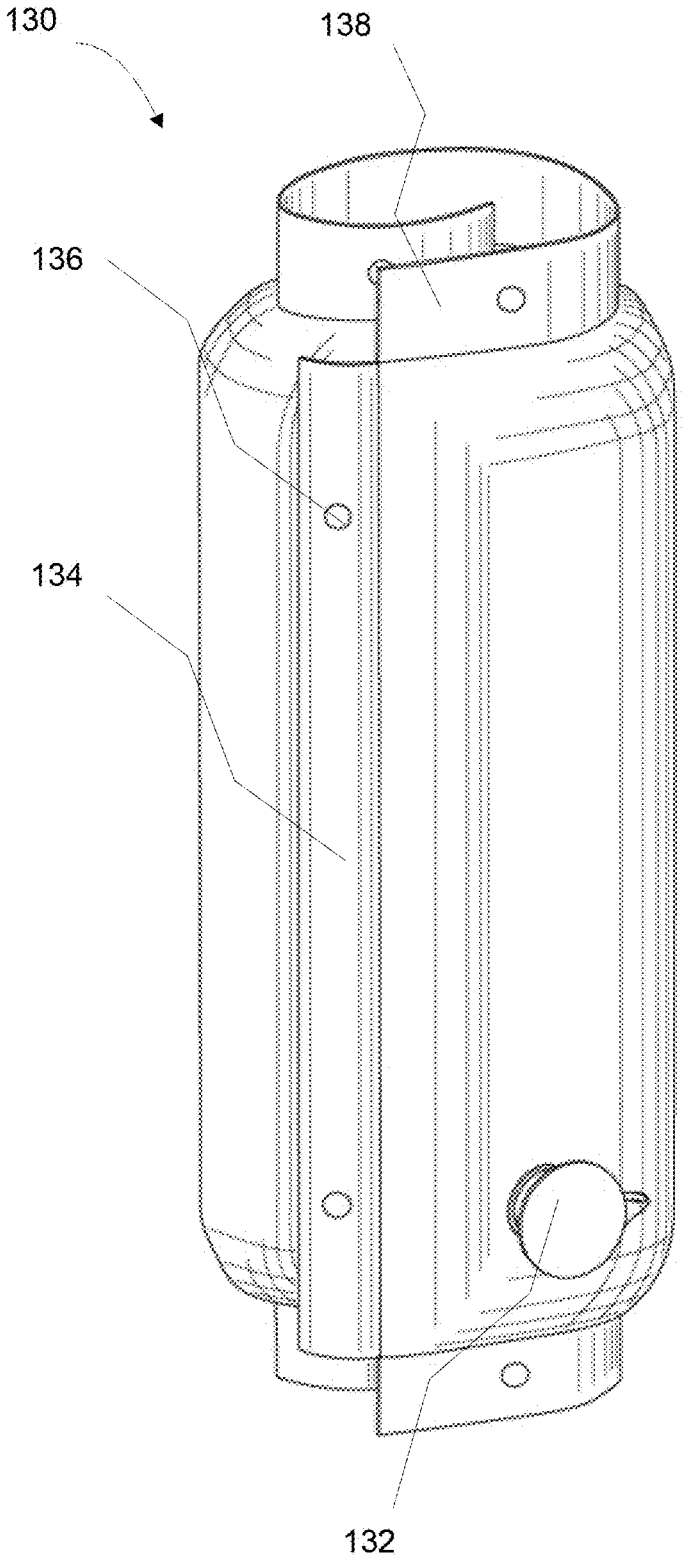
FIG. 8 illustrates an example of a rollable and foldable cooling pack configuration according to example embodiments.

FIG. 8 illustrates an example of a rollable and foldable cooling pack configuration according to example embodiments. Referring to FIG. 8, the cooling pack may be rollable, foldable, bendable and may even have position memory properties, such as internal metal strips that hold a bended position in place until the position is readjusted by a user. The flexibility of the cooling pack enables the pack to be maneuvered into a position that can cool or warm contents of the cooler faster by direct contact, such as by rolling the pack around a bottle or similar container.

Figure 9:
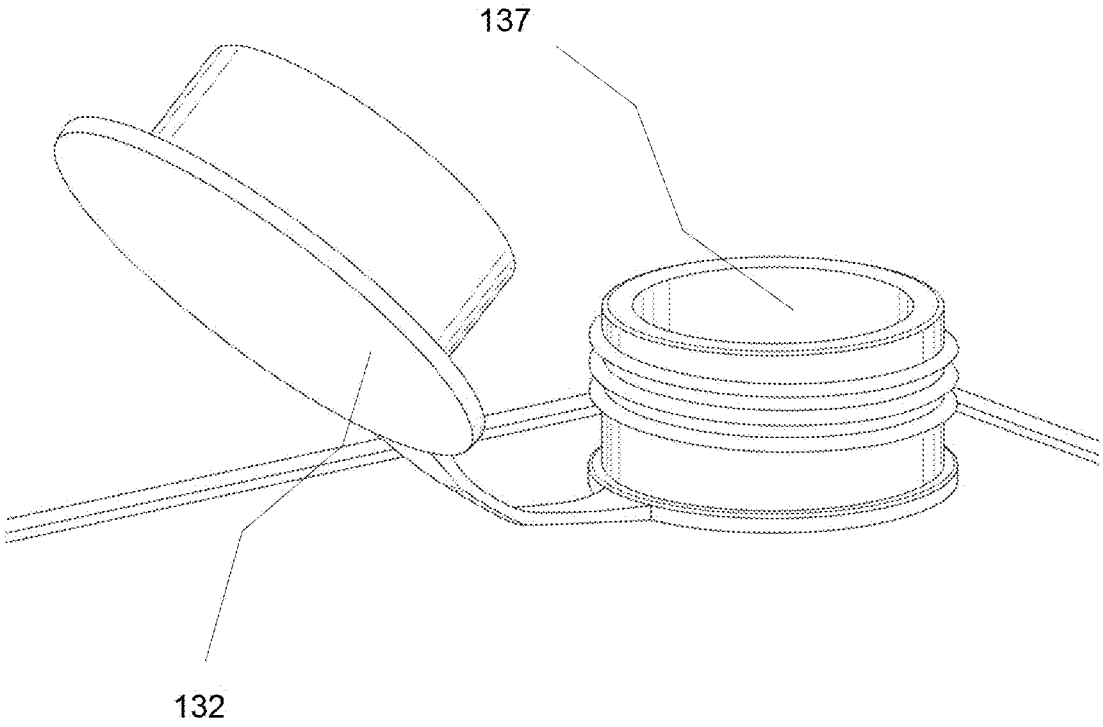
FIG. 9 illustrates a detailed view of a liquid access point for the cooling pack according to example embodiments.

FIG. 9 illustrates a detailed view of a liquid access point for the cooling pack according to example embodiments. Referring to FIG. 9, the access cap or lid 132 may be snapped into position or screwed on to a threaded nozzle 137 for securing purposes to hold the liquid inside the pack.

Figure 10:
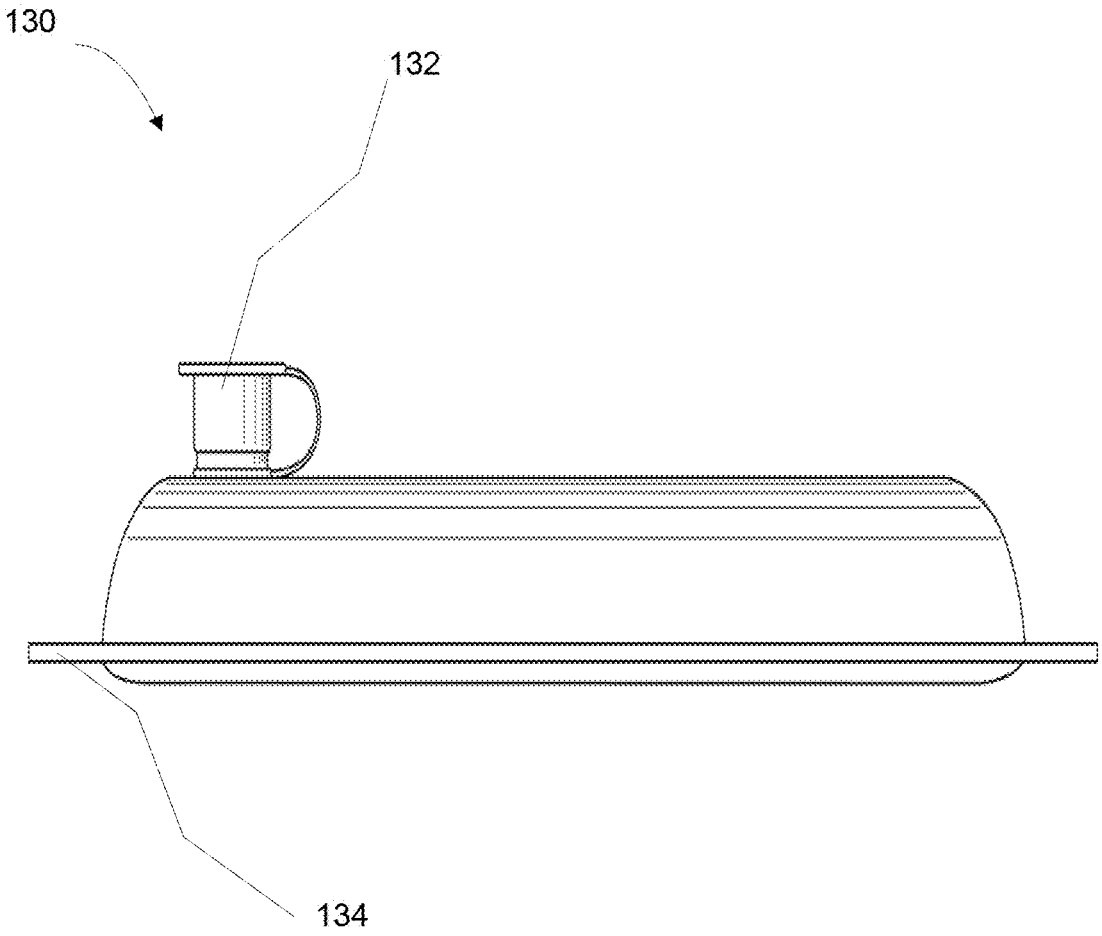
FIG. 10 illustrates a side view of a cooling pack according to example embodiments.

FIG. 10 illustrates a side view of a cooling pack according to example embodiments. Referring to FIG. 10, the pack 130 may have a sizable container volume with an edge 134 around a bottom portion of the container bladder. The lid 132 may be located in a top portion of the pack.

Figure 11:
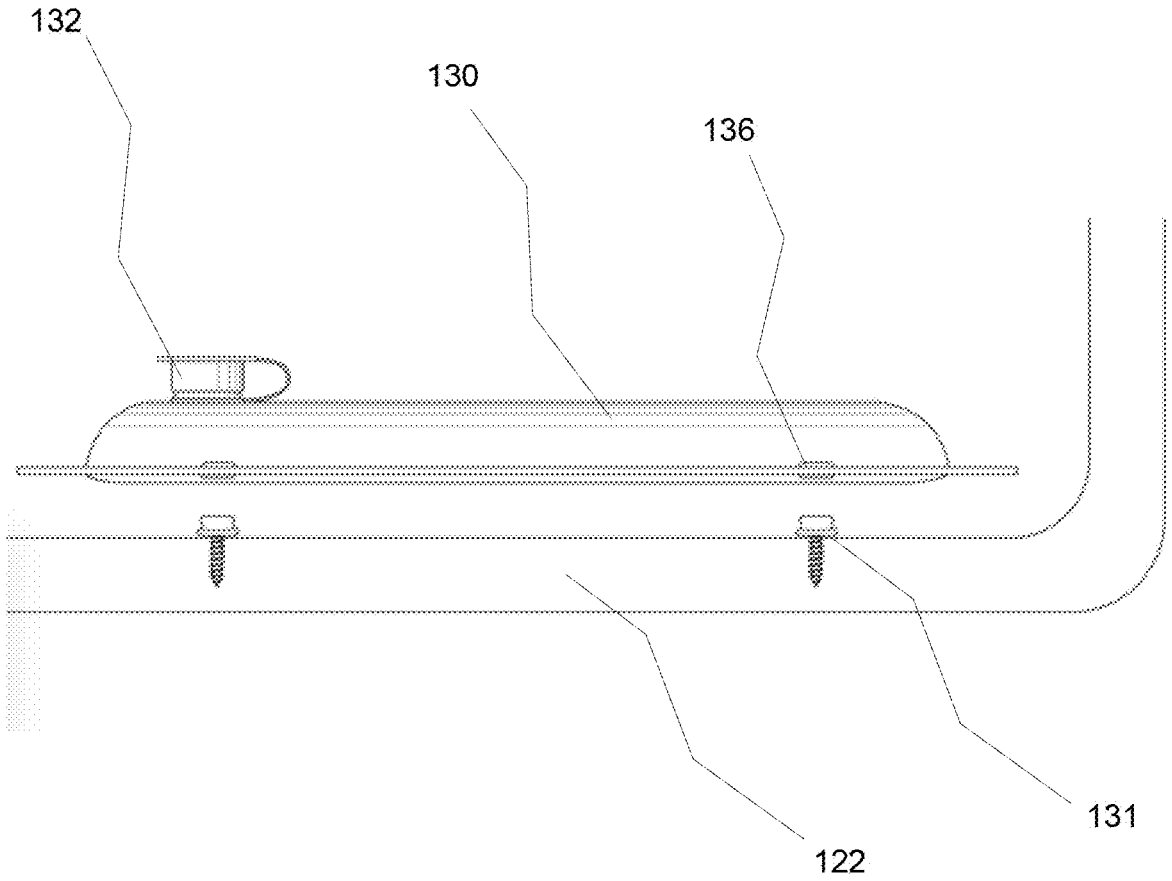
FIG. 11 illustrates a side view of a cooling pack affixed to a cooler wall according to example embodiments.

FIG. 11 illustrates a side view of a cooling pack affixed to a cooler wall according to example embodiments. Referring to FIG. 11, the pack 130 may be secured to a wall 122 of a cooler by snaps 136, which snap onto the snap fasteners 131, which are affixed to the cooler wall by a screw.

FIG. 12 illustrates a detailed view of a snap screw stud fastener according to example embodiments. Referring to FIG. 12, the snap fastener 131 may have a snap receiving head 133 and a screw base 135 to be embedded into a cooler body or other surface.

One example embodiment may include a device with a first liquid container having a bladder and a plurality of flaps, and a second liquid container having a bladder and a plurality of flaps, and one of the flaps of the second liquid container is affixed to one of the flaps of the first liquid container. The flaps may also be affixed to internal walls of an inside of a cooler to hold a specific position for rapid cooling of objects in the cooler. Each of the first and second liquid containers include respective access caps to permit liquid to be inserted or removed from the bladders of the respective liquid containers. The first liquid container and the second liquid container each may include two, three or four flaps. Each of the plurality of flaps may include one or more holes which has an installed snap button cap or snap button socket. The first liquid container and the second liquid container are affixed to an internal surface of a cooler. The internal surfaces of the cooler includes a bottom floor surface and side wall surfaces, such as four surfaces for a square or rectangular cooler. Other cooler designs are contemplated, such as collapsible coolers, circular coolers, etc. The first liquid container and the second liquid container may be affixed to two or more internal surfaces of a cooler and in another example three or more internal surfaces of a cooler. The first liquid container and the second liquid container are deformable. The first and second liquid containers are each shaped as one of a square, rectangle, triangle and circle and may include other shapes. The first and second liquid containers include one or more circular cavities form-fitted to a beverage container.

Another example embodiment may include a cooler having a plurality of affixing elements disposed on surfaces of an internal portion of the cooler, and a plurality of liquid containers affixed to the affixing elements in a fixed position inside the cooler.

The use of the liquid container(s) or pack(s) 130 does not necessarily need to be for a cooler, but instead may include any application that requires large ice/warming packs. The packs may connect to one another to form a larger pack. The packs may be emptied when not in use for easy storage and also reduction of weight. The packs may connect to cooler walls including both hard and soft coolers. The packs can also be used in backpacks or cooler backpacks by using VELCRO. As illustrated in the figures, the packs may be available in multiple shapes and sizes. For existing coolers, the snap screws can be installed on a cooler wall with a protruding snap portion so the packs could be snapped into the cooler walls with receded snap portions. The packs can also be laid flat on the bottom of the cooler without being attached to the cooler internal surfaces.

The screw-in studs could be screwed into the cooler wall. The drain valve can be a push valve or a screw in valve. The material of the cooling pack may be a flexible waterproof fabric. Example materials may include a thermoplastic polyurethane (TPU), a polyvinyl chloride (PVC) coated fabric, rubber, polyurethane laminate (PUL), and polytetrafluoroethylene (PTFE). Those materials provide both flexibility and durability while ensuring water resistance. The packs are capable of being filled with various liquids, including water, salt water, gel, and other suitable liquids. The flexibility enables users to customize its functionality for different applications.

The packs may be joined together to line the inside of a cooler, act as a divider within a cooler, or serve as a medical ice pack wrap. Its adaptability makes it suitable for various purposes, expanding its potential market and utility.

The shapes of the cooler packs is not limited to a specific form and can be designed in various shapes and forms, ranging from rectangles to cylinders, cubes, triangles, or any other desired shape. This flexibility allows for customization based on specific use cases. In one example, waterproof fabrics combine a thermoplastic polyurethane membrane with a base textile (e.g., nylon or polyester fabric), resulting in materials that are both flexible and waterproof. PVC coated fabric involves a poly-vinyl chloride coating on polyester fabric, making a suitable form of luggage, bags, cases, and other protective coverings. Polyurethane laminate (PUL) fabric refers to polyester or cotton fabric with one or two layers of polyurethane, providing waterproof properties. The cooler packs with openings (see FIG. 4) can offer strategically placed openings or pockets to cool objects, such as drinks or other items. The openings permit direct contact between the frozen pack and the target object, facilitating efficient cooling.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

One having ordinary skill in the art will readily understand that the application as discussed above may be practiced with hardware elements in configurations that are different than those which are disclosed. Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

While preferred embodiments of the present application have been described, it is to be understood that the embodiments described are illustrative only and the scope of the application is to be defined solely by the appended claims when considered with a full range of equivalents and modifications thereto.

The invention claimed is:

1. A device comprising:

a first liquid container comprising a bladder, a drain valve, and a plurality of flaps; and a second liquid container comprising a bladder, a drain valve, and a plurality of flaps, wherein one of the flaps of the second liquid container is affixed to one of the flaps of the first liquid container, and wherein another one of the flaps of the first liquid container is affixed to an interior side wall of a cooler and another one of the flaps of the second liquid container is affixed to another interior side wall of the cooler.

2. The device of claim 1, where each of the first and second liquid containers comprise respective access caps to permit liquid to be inserted or removed from the bladders of the respective liquid containers.

3. The device of claim 1, wherein the first liquid container and the second liquid container each comprise two, three or four flaps.

4. The device of claim 1, wherein each of the plurality of flaps comprises one or more holes.

5. The device of claim 4, wherein each of the one or more holes has an installed snap button cap or snap button socket.

6. The device of claim 1, wherein the first liquid container and the second liquid container are affixed to an internal surface of a cooler.

7. The device of claim 6, wherein the internal surface of the cooler comprises a bottom floor surface and a side wall surface.

8. The device of claim 6, wherein the first liquid container and the second liquid container are affixed to two or more internal surfaces of a cooler.

9. The device of claim 6, wherein the first liquid container and the second liquid container are affixed to three or more internal surfaces of a cooler.

10. The device of claim 1, wherein the first liquid container and the second liquid container are deformable.

11. The device of claim 1, wherein the first and second liquid containers are each shaped as one of a square, rectangle, triangle and circle.

12. The device of claim 1, wherein the first and second liquid containers include one or more circular cavities form-fitted to a beverage container.

* * * * *